US006080033A

United States Patent [19]

Fladwood et al.

[11] Patent Number: 6,080,033

[45] Date of Patent: Jun. 27, 2000

[54] FOOTPRINT GENERATING TOY

[76] Inventors: Ronald S. Fladwood; Deirdre L. Fladwood, both of 29503 Evergreen Dr., Waterford, Wis. 53185

[21] Appl. No.: 09/213,367

[22] Filed: Dec. 17, 1998

Related U.S. Application Data

[60] Provisional application No. 60/068,167, Dec. 19, 1997.

[51] Int. Cl.[7] ..... A63H 33/32; A43B 3/00

[52] U.S. Cl. ..... 446/26; 446/70; 36/112; 101/103; D2/899; D2/952

[58] Field of Search ..... 446/26, 70, 74; 36/7.1 R, 7.5, 7.6, 112; 101/103, 333; 401/6, 7, 8; D2/899, 952

[56] References Cited

U.S. PATENT DOCUMENTS

| | | | |
|---|---|---|---|
| D. 224,183 | 7/1972 | Straub et al. . | |
| D. 224,184 | 7/1972 | Straub et al. | D2/273 |
| D. 228,701 | 10/1973 | Osterguard . | |
| D. 247,832 | 5/1978 | Glasgow et al. . | |
| D. 281,287 | 11/1985 | Vitrac . | |
| D. 287,903 | 1/1987 | Jones et al. . | |
| D. 309,670 | 8/1990 | Mendonca | D2/321 |
| D. 347,105 | 5/1994 | Johnson | D2/952 |
| D. 380,289 | 7/1997 | Sand | D2/959 |
| 438,179 | 10/1890 | Quarrie . | |
| 1,938,617 | 12/1933 | Augusta . | |
| 2,754,598 | 7/1956 | Aull . | |
| 3,032,897 | 5/1962 | Gelineau . | |
| 3,402,485 | 9/1968 | McMorrow . | |
| 3,538,628 | 11/1970 | Einstein, Jr. . | |
| 3,823,494 | 7/1974 | Slemp . | |
| 4,050,167 | 9/1977 | Senter | 36/32 R |
| 4,050,168 | 9/1977 | Pace . | |
| 4,896,439 | 1/1990 | Morgan | 36/7.5 |
| 4,897,935 | 2/1990 | Fel | 36/7.7 |
| 5,360,362 | 11/1994 | Cernansky et al. | 446/16 |
| 5,586,501 | 12/1996 | Burbuera et al. | 104/368 |
| 5,675,915 | 10/1997 | Faughn et al. | 36/7.5 |
| 5,765,478 | 6/1998 | Massey | 101/129 |
| 5,836,090 | 11/1998 | Smith | 36/7.6 |

FOREIGN PATENT DOCUMENTS

| | | |
|---|---|---|
| 1222578 | 6/1960 | France . |
| 14015 | of 1911 | United Kingdom . |

*Primary Examiner*—Robert A. Hafer
*Assistant Examiner*—Laura Fossum
*Attorney, Agent, or Firm*—Richard C. Litman

[57] ABSTRACT

A footprint generating toy that is worn on a person's foot, and enables the wearer to leave liquid or dry simulated footprints. The footprint generating toy is made from an absorbent, moisture retaining material that, after being soaked in water, will leave liquid simulated footprints as the wearer walks. The footprint generating toy may also be used dry, to leave simulated footprint impressions in soft surfaces such as sand, snow or loose dirt.

3 Claims, 2 Drawing Sheets

FOOTPRINT GENERATING TOY

CROSS-REFERENCE TO RELATED APPLICATION

This application claims the benefit of U.S. Provisional Patent application Ser. No. 60/068,167, filed Dec. 19, 1997.

BACKGROUND OF THE INVENTION

1. Field of the Invention

The present invention relates generally to toy foot wear and more particularly, to a footprint generating toy worn on an person's foot for leaving simulated footprint impressions on deformable surface such as snow or sand, or simulated footprint images on hard, non-deformable surfaces such as concrete.

2. Description of Related Art

A toy provides a child with a great deal of pleasure and enjoyment with a child spending many hours playing with his or her favorite toy. The toy market is one of the most viable commercial markets in the world with the toy industry generating billions of dollars in revenue worldwide. One incredibly enjoyable activity for both kids and adults is creating footprints in the snow or sand or on concrete that would lead the causal observer to believe that an animal, such as an animal thought to be extinct, has recently passed that way and may still be nearby. While footprint generating toys are known in the art, the prior art fails to describe a footprint generating toy with the novel and innovative features of the present invention.

It is known in the prior art to provide decorations, embossed figures, serrations, and the like on and in the soles of footwear. Some of these can be used to create an imprint or impression of the design, located on the sole of the footwear, on a soft surface, such as sand or loose dirt. It is also known in the prior art to provide toys that can leave liquid footprint images as the toy moves along a surface.

However, none of the known prior art allows for a footprint generating toy that can be worn on a person's foot, and which can leave either impressions in a soft surface or liquid footprints on a hard surface.

U.S. Pat. No. 5,360,362 discloses a footprint generating toy which leaves liquid footprints on a surface. However, this device is pushed along the ground and is not worn upon a person's feet.

U.S. Pat. No. 4,050,167 discloses an article of footwear with a three dimensional inset figure in a recessed sole. This device is not designed to leave liquid footprints on a surface.

U.S. Pat. No. 3,402,485 discloses animal track footwear soles. These soles are designed for leaving tracks in a soft surface, such as dirt or sand. They are not designed to leave liquid footprints.

U.S. Pat. No. 3,032,897 discloses duck feet cloppers that strap onto a person's feet. These devices are not intended to leave either liquid or dry footprints.

None of the above inventions and patents, taken either singly or in combination, is seen to describe the instant invention as claimed.

SUMMARY OF THE INVENTION

Accordingly, it is a principal object of the invention to provide a footprint generating toy wherein the toy is made of an absorbent, moisture retaining material.

It is another object of the invention to provide a footprint generating toy wherein the toy is made of a material that is substantially non-deformable.

It is a further object of the invention to provide a footprint generating toy wherein the toy has the simulative configuration of an animal's foot.

Still another object of the invention is to provide a footprint generating toy that may be easily donned and removed from the wearer's feet.

It is an object of the invention to provide improved elements and arrangements thereof in an apparatus for the purposes described which is inexpensive, dependable and fully effective in accomplishing its intended purposes.

In view of the foregoing limitations of the footprint generating devices described in the prior art, the present invention provides an improved footprint generating toy, made of an absorbent, moisture retaining material, that may be worn on a person's feet for generating liquid simulated footprints on a surface.

The invention comprises a body portion and a sole, both which may have the simulated configuration of an animal's foot. Both the body portion and sole are made of a substantially non-deformable, absorbent material that will retain moisture after being soaked in a liquid. The material should retain enough moisture so that a large number of liquid footprints may be generated before the footprint generating toy needs to be re-saturated with liquid. Also, the material should be sufficiently rigid to support the weight of the wearer, and to allow simulated footprint impressions to be generated in soft surfaces, such as sand, snow or loose dirt. The body portion has a top side for receiving the wearer's foot. The wearer's foot is secured to the body portion by a toe strap assembly and an instep strap assembly.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
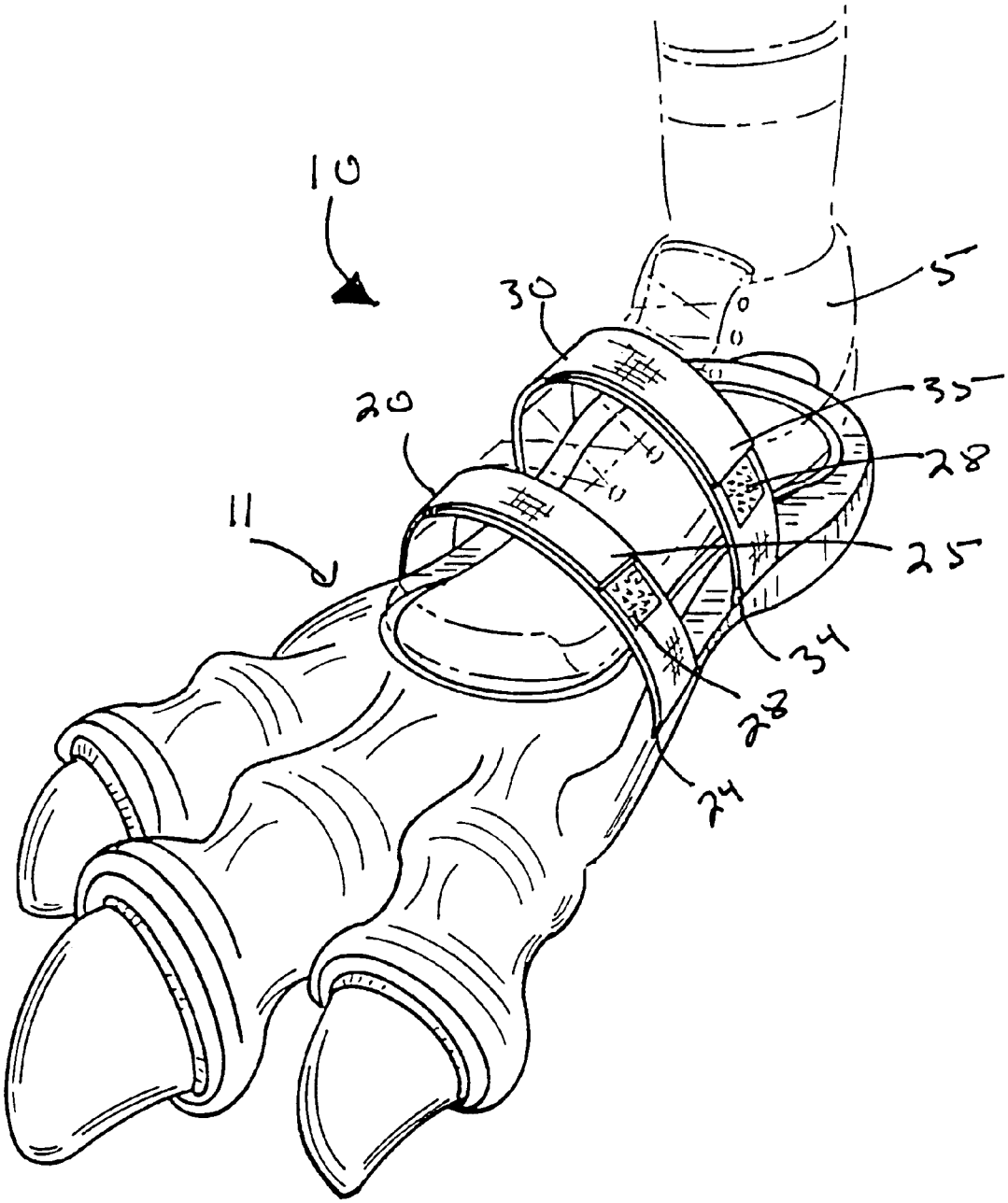
FIG. 1 is a perspective view of a footprint generating toy according to the present invention.

Referring now to FIG. 1, a toy for generating a simulated footprint 10 of the present invention is shown being worn on a person's foot 5. The footprint generating toy 10 comprises a body portion 11 that is made of a substantially non-deformable, absorbent material that will retain moisture after being soaked in a liquid. The material should retain enough moisture that a large number of liquid simulated footprints may be generated before the footprint generating toy 10 needs to be re-saturated with liquid. Also, the material should be sufficiently rigid to support the weight of the wearer, and to allow simulated footprint impressions to be generated onto soft surfaces, such as sand, snow or loose dirt. Such material may be chosen from open-celled or foamed plastics such as polyurethane foam, well known in the art.

Figure 2:
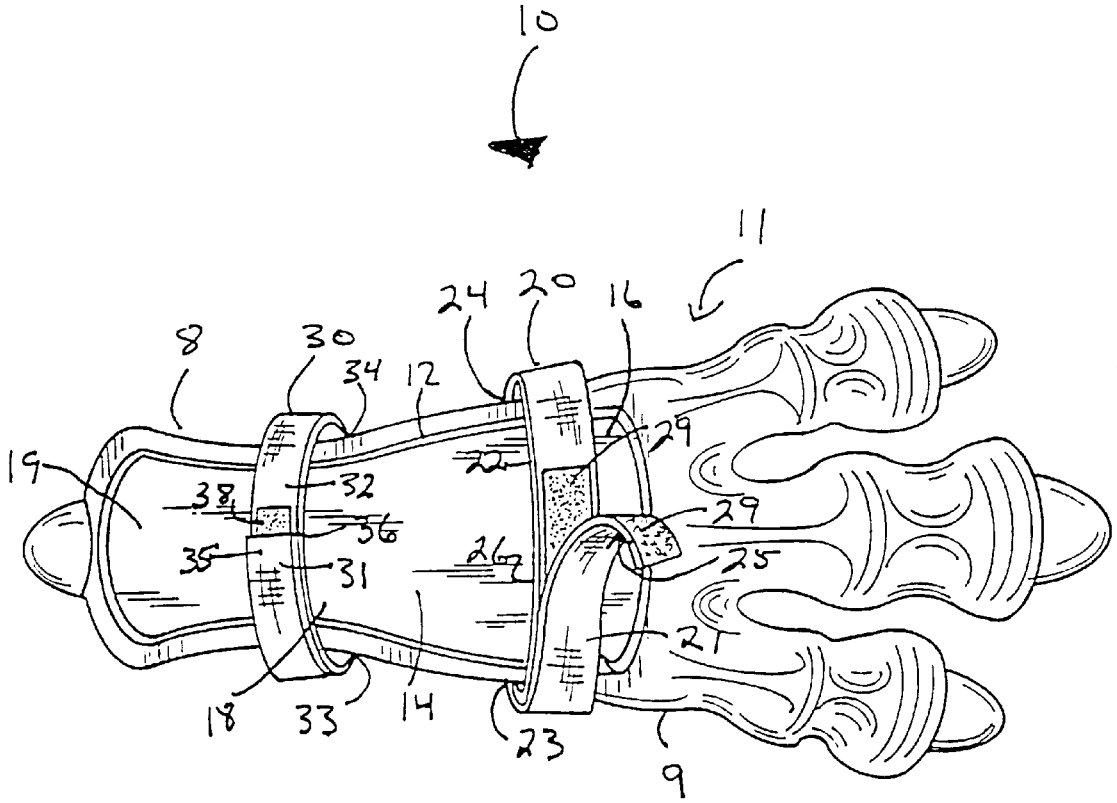
FIG. 2 is a top plan view of the footprint generating toy according to the present invention.

As best seen in FIG. 2 the body portion 11 has a foot retaining portion 14 located on its top side 12. The foot retaining portion 14 supports the wearer's foot 5, and is comprised of three contiguous portions: a toe portion 16, an instep portion 18, and a heel portion 19.

Figure 3:
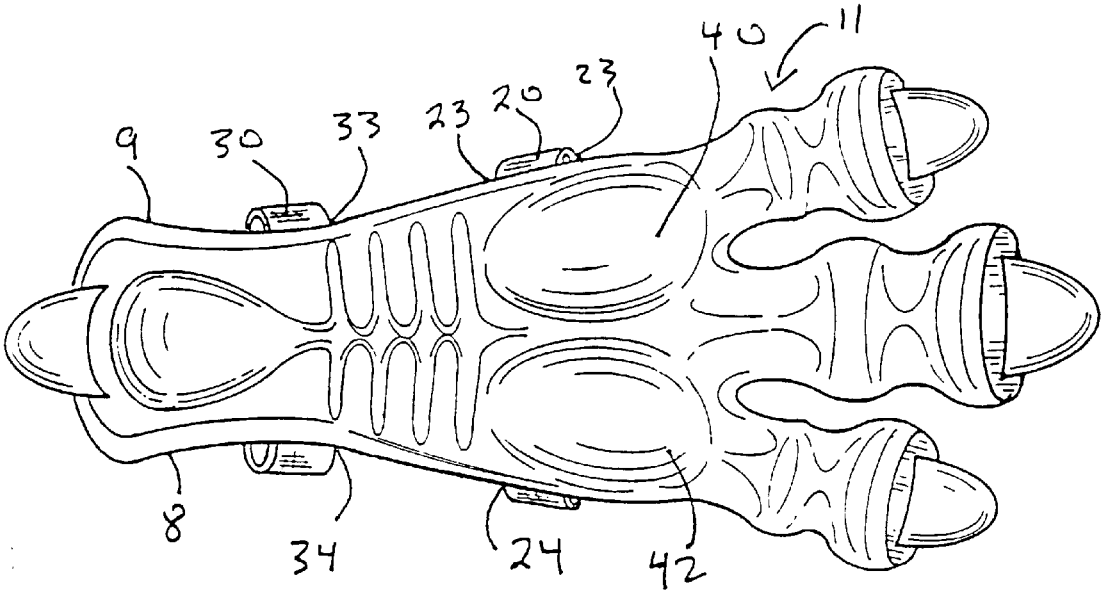
FIG. 3 is a bottom plan view of the footprint generating toy according to the present invention.

As seen in FIG. 3 the body portion 11 has an integrally attached sole portion 40 that is molded to have a three dimensional pattern 42. Both the body portion 11 and sole 40 may have the configuration of a simulated animal's foot, thereby allowing the wearer to simulate animal tracks on either hard or soft surfaces.

As seen in FIGS. 1 and 2, the body portion 12 is attached to the wearer's foot 5 by a toe strap assembly 20 and an instep strap assembly 30. The toe strap assembly 20 is located at the toe portion 16, and comprises a first toe strap 22 that is attached to a side 8 of body portion 12 at a first end 24, and a second toe strap 21 that is attached to an opposite side 9 of body portion 12 at a first end 23. The first toe strap 22 has a second end 26 that is secured to a second end 25 of the second toe strap 21 by an adjustable hook and loop fastener 29. The instep strap assembly is located at the instep portion 18, and comprises a first instep strap 32 that is attached to side 8 of body portion 12 at a first end 34, and a second instep strap 31 that is attached to opposite side 9 of body portion 12 at a first end 33. The first instep strap 32 has a second end 36 that is secured to a second end 35 of the second instep strap 31 by an adjustable hook and loop fastener 38.

The novel and innovative design and functional features of the footprint generating toy of the present invention provides the consumer with countless hours of entertainment and enjoyment for both young and old.

The preferred embodiment of the present invention disclosed herein is intended to be illustrative only and is not intended to limit the scope of the invention. It should be understood by those skilled in the art that various modifications and adaptations of the present invention as well as alternative embodiments of the present invention may be contemplated. It is to be understood that the present invention is not limited to the sole embodiment described above, but encompasses any and all embodiments within the scope of the following claims.

We claim:

1. A toy for generating a simulated footprint, comprising:

a body portion comprising a top side having a foot retaining portion for receiving a wearer's foot, a toe portion, an instep portion, and a heel portion;

a sole having a three dimensional pattern and being integrally formed on a bottom side of said body portion;

a toe strap assembly located at said toe portion comprising a first toe strap and a second toe strap, said first toe strap having a first end attached to a first side of said body portion, and a second end, said second toe strap having a first end attached to a second side opposite said first side of said body portion, and a second end;

a first adjustable fastener for securing together said second end of said first toe strap and said second end of said second toe strap;

an instep strap assembly located at said instep portion comprising a first instep strap and a second instep strap, said first instep strap having a first end attached to a first side of said body portion and a second end, said second instep strap having a first end attached to a second side opposite said first side of said body portion, and a second end;

a second adjustable fastener for securing together said second end of said first instep strap and said second end of said second instep strap;

said body portion, including said top side and said sole having said three dimensional pattern, being integrally formed of a substantially non-deformable absorbent open-cell foam that retains moisture after being soaked in a liquid;

said body portion being defined by a configuration which simulates an animal's foot, wherein said top side simulates a top of an animal's foot and said sole having said three dimensional pattern simulates a bottom of an animal's foot; and wherein said body portion, including said top side and said sole having said three dimensional pattern, are adapted to generate animal tracks on a hard surface and on a soft surface, the tracks being formed on the hard surface by the absorption and subsequent release of moisture from the three dimensional pattern on the sole of the absorbent open-cell foam on the hard surface, and the tracks being formed on the soft surface by the impression of the three dimensional pattern on the sole of the substantially non-deformable open-cell foam into the soft surface.

2. The toy for generating a simulated footprint according to claim 1, wherein:

said body portion is made of polyurethane foam.

3. The toy for generating a simulated footprint according to claim 1, wherein:

said first adjustable fastener and said second adjustable fastener are each hook and loop fasteners.

* * * * *